US005103983A

United States Patent [19]

Roberts

[11] Patent Number: 5,103,983

[45] Date of Patent: Apr. 14, 1992

[54] REFUSE RECEIVING DEVICE

[75] Inventor: Neville Roberts, Eddington, Australia

[73] Assignee: Elvyne Hogan, Hawthron, Australia

[21] Appl. No.: 606,743

[22] Filed: Oct. 5, 1990

[30] Foreign Application Priority Data

Oct. 6, 1989 [AU] Australia ..... 42619/89

[51] Int. Cl.[5] ..... B07C 5/16

[52] U.S. Cl. ..... 209/645; 194/212; 209/930; 209/933; 220/909

[58] Field of Search ..... 209/645, 648, 649, 650, 209/933, 698, 647, 930; 194/339, 340, 341, 212; 220/929.09; 193/18, 32

[56] References Cited

U.S. PATENT DOCUMENTS

| | | | |
|---|---|---|---|
| 1,704,930 | 3/1929 | Wagner | 194/339 |
| 2,198,285 | 4/1940 | Krenzer | 209/650 |
| 2,391,412 | 12/1945 | Gorton | 209/645 X |
| 2,913,761 | 11/1959 | Meyer | 193/32 X |
| 3,187,872 | 6/1965 | Hill et al. | 193/32 |
| 3,331,507 | 7/1967 | Bossung | 209/650 |
| 4,658,965 | 4/1987 | Smith | 209/933 |
| 4,760,925 | 8/1988 | Stehle et al. | 209/645 |

FOREIGN PATENT DOCUMENTS

| | | | |
|---|---|---|---|
| 522224 | 3/1931 | Fed. Rep. of Germany | 209/649 |

*Primary Examiner*—Donald T. Hajec
*Attorney, Agent, or Firm*—Ladas & Parry

[57] ABSTRACT

A refuse device for receiving and separately holding heavy articles and light refuse articles. The device includes a first and second open-topped refuse receptacle and a pivoting flap overlying the receptacles. The flap is pivotable between a first position in which it is inclined down to a first one of the receptacles, and a second position in which it is inclined down to the second receptacle. A biasing device is provided to urge the flap to its second position whereby a light article passes across the flap into the second receptacle, and a heavy article causes tilting of the flap member to its first position and then is able to pass across the flap member into the first receptacle.

9 Claims, 3 Drawing Sheets

REFUSE RECEIVING DEVICE

BACKGROUND OF THE INVENTION

This invention relates to a device for receiving refuse or rubbish, and in particular relates to a device which will automatically separate one type of article from another type of article.

People today have a greater awareness of the need to recycle some articles which are normally considered as waste. However the benefits to be gained from that awareness are often not realized due to the lack of suitable facilities. In particular, garbage bins located in public areas are not intended to differentiate between particular types of waste, and as such receive all types of waste for removal and final depositing at a waste collection centre. Therefore, there is a need for bins which allow people the opportunity to take an active step in separating recyclable refuse from non-recyclable refuse.

SUMMARY OF THE INVENTION

An object of the present invention is to provide a refuse receiving device which is capable of separating one type of article from another type of article.

The present invention provides a refuse receiving device for receiving heavy articles and light articles, said device being capable of separating the heavy articles into a first collection zone and the light articles into a second collection zone, said device comprising a pivotal flap held in an inclined rest position by a biasing means, said pivotal flap being inclined downwardly from a first end to a second end for the passage of said light articles thereacross to said second collection zone, said second collection zone being located adjacent to and in communication with said second end, wherein said pivotal flap is adapted to move away from said rest position upon engagement at or adjacent said first end with a heavy article, allowing said heavy article to pass directly from said pivotal flap into said first collection zone located adjacent to and in communication with said first end and wherein said pivotal flap remains in said rest position upon engagement at or adjacent said first end with a light article allowing said light article to travel thereacross, down the inclined flap into the second collection zone.

The biasing means which holds the pivotal flap in an inclined rest position is preferably a weight or the like. The weight urges the flap into its rest position with a predetermined force which is greater than the weight applied to the flap by a light article but less than the weight applied to the flap by a heavy article when the respective article engages the flap.

In another form, the device includes a resilient restricting means supported near said first end so as to define with said first end a space which allows passage of heavy articles and communicates with the first collection zone. Preferably the resilient restricting means is adapted to engage the heavy article as it passes from the first end through the space, to slow the speed of the heavy article as it enters the first collection zone.

The resilient restricting means is preferably a rubber strip or the like. The rubber strip is preferably parallel to the first end of the pivotal flap such that a passage is defined between the first end and the rubber strip which is of a dimension less than the maximum width of a heavy article; the size of the passage being determined when the rubber strip is in its rest position, and when the pivotal flap is away from its rest position due to the engagement thereof with a heavy article. In this respect, the heavy article will then abut the rubber strip forcing same away from its rest position, and causing the heavy article to slow as it passes through to the first collection zone. The resilient restricting means provides an advantage when the heavy articles are glass containers, and as such are prone to breakage if passage into the first collection zone is too fast.

In a preferred form, the refuse receiving device includes an inlet opening which is protected by a shield or the like such that articles are not able to be thrown or forceably placed therewithin. An entrance slope is provided which gives access to the inlet opening below the shield, so that articles may be placed on the entrance slope and then roll or slide down the slope to the opening. In this way, the force with which an article engages the flap is regulated, due to the amount of energy gained by the article through the drop from the inlet opening to the flap. This excludes the possibility of an article being given more energy than necessary by a consumer throwing an article therein. In this respect, damage to the flap will be limited, and light articles will not be provided with extra energy suitable to impart enough force on the flap to cause the flap to pivot thus allowing a light article into the first collection zone.

The first and second collection zones are preferably in the form of a basket or the like attached such that the openings thereof communicate respectively with the space defined between the first end of the flap and the resilient restricting means, and the second end of the flap. In this form, light articles will pass across the pivotal flap when in its inclined rest position, and will fall into the second collection zone, whereas heavy articles will cause the flap to pivot, creating the space between the free edge of the flap and the resilient restricting means, through which the article will pass into the first collection zone. In a preferred form, the baskets may be pivotally attached to the refuse receiving device so that they may be emptied simply by pivoting and tipping the contents into a further receptacle.

The refuse receiving device of the present invention allows consumers to place various articles, such as glass bottles, plastic bottles, steel or aluminium cans, or other glass, plastic, steel, or aluminium containers, all into the one opening with the subsequent separation of the heavier glass articles from the remaining articles. Alternatively, the biasing means may be such that the refuse receiving device can separate articles of closer weight, such as plastic and aluminium articles. Ideally, the refuse receiving device may be placed adjacent to a normal garbage bin with direction for consumers to place recyclable matter in the refuse receiving device while the remaining refuse is placed within the normal garbage bin. Further, a refuse receiving device as per this invention is ideally suited for placement outside or within a cafeteria or canteen or the like, where a large number of these types of articles will be used and subsequently discarded.

In order to assist in arriving at an understanding of the present invention, a preferred embodiment is illustrated in the attached drawings. However, it should be understood that the following description is illustrative only and should not be taken in any way as a restriction on the generality of the invention as described above.

DETAILED DESCRIPTION OF THE DRAWINGS

Figure 1B:
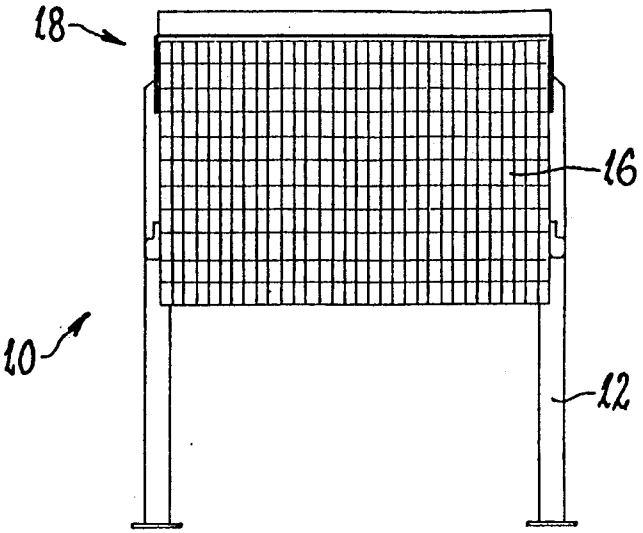
FIG. 1*b* is a side view of the embodiment of FIG. 1*a*.
Figure 1A:
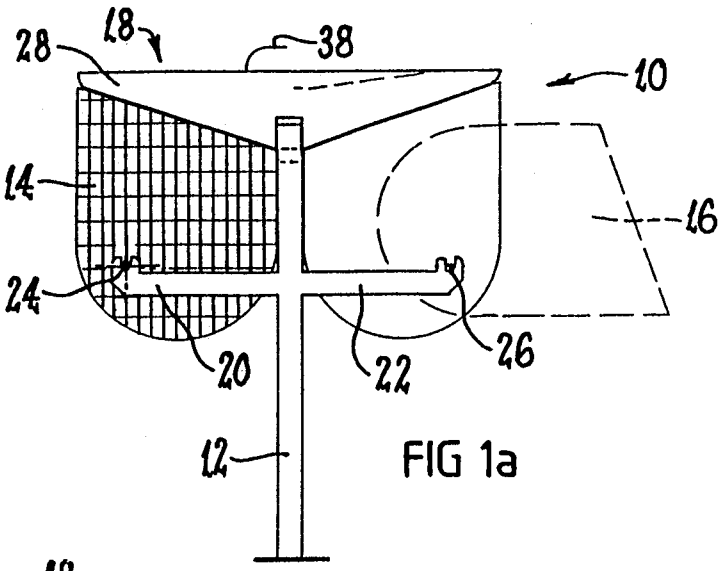
FIG. 1*a* is an end view of a preferred embodiment of the present invention.
Figure 1C:
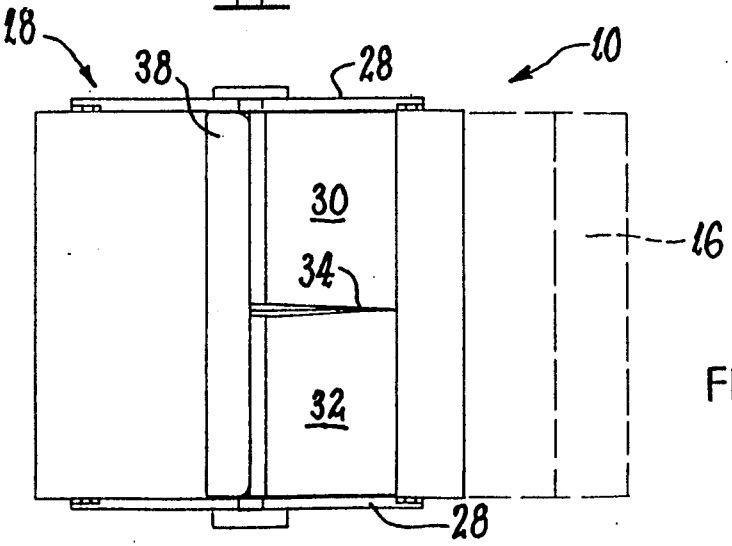
FIG. 1*c* is a top view of the embodiment of FIG. 1*a*.

Illustrated in FIGS. 1*a*, 1*b*, and 1*c* is a refuse receiving device 10 comprising a support frame 12, a first collection zone 14, a second collection zone 16, and a separating area 18. Collection zones 14 and 16 are metal baskets pivotally attached to frame 12 on arms 20 and 22 respectively at pivot points 24 and 26 respectively. Top edges of respective sidewalls of the collection zones 14 and 16 are laterally adjacent a first horizontal line. As illustrated in FIG. 1*a*, the baskets are capable of being pivoted to a tipping position for emptying.

The external configuration of separating area 18 includes a cover means which comprises sidewalls 28, inlet slopes 30 and 32 separated by barrier 34 and leading to opening 36 (not shown in FIGS. 1*a*, 1*b*, or 1*c*). Shield 38 extends over opening 36, and slightly over the free edges of slopes 30 and 32 such that refuse articles must be placed on slopes 30 or 32, and may not be dropped directly through opening 36 by a user. The inlet slopes 30 and 32 serve as guide surfaces inclined downwardly to an edge thereof relative to a second horizontal line normal to the above mentioned first horizonal line.

Figure 2:
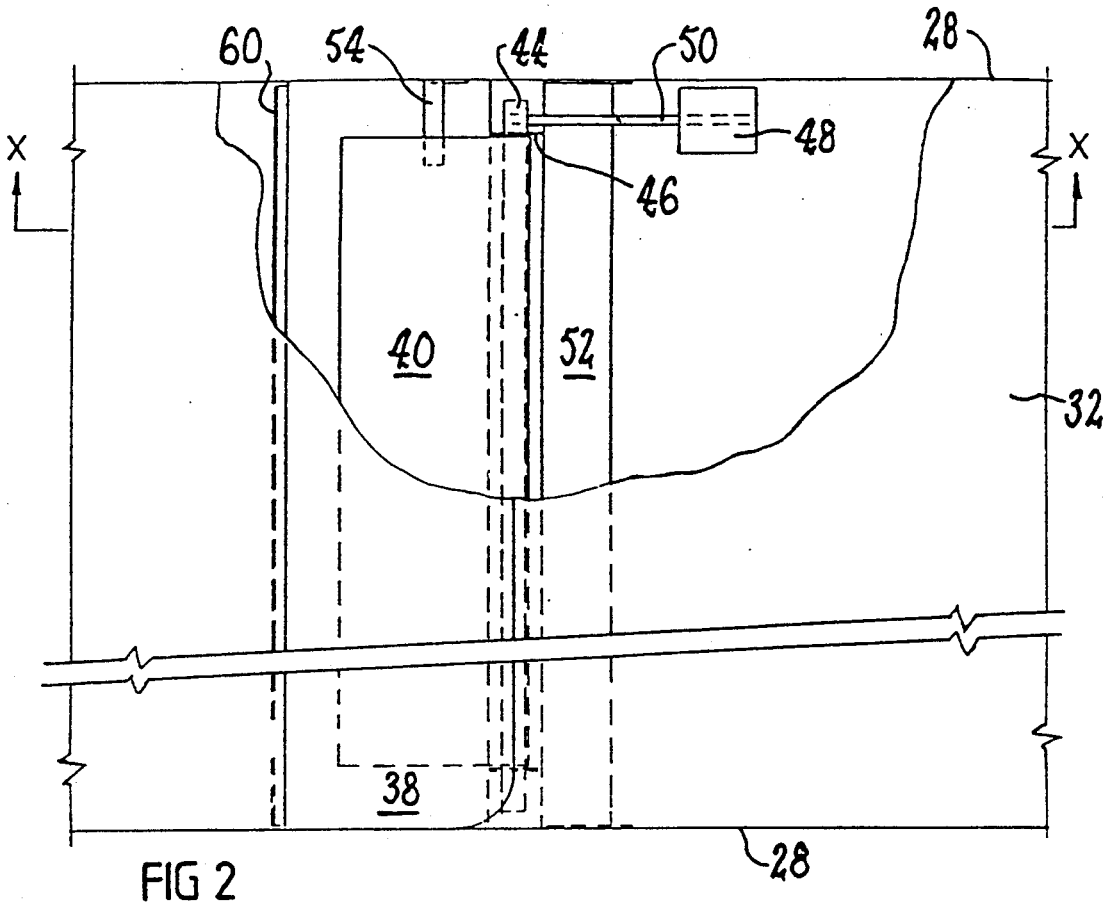
FIG. 2 is a partial top view in partial section of the embodiment of FIG. 1*a*.
Figure 3:
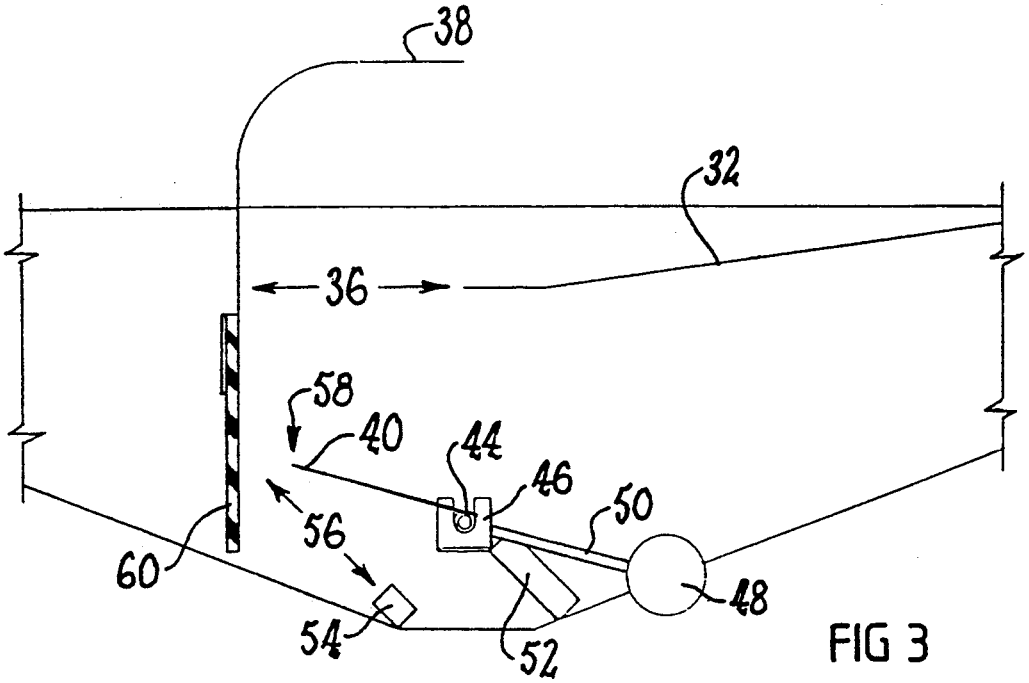
FIG. 3 is a section along line X—X of FIG. 2.

Illustrated in FIGS. 2 and 3 is the internal mechanism of separating area 18. The internal mechanism comprises an enlongate generally rectangular shaped pivotal flap 40 secured along lower end 42 to tube 44, and supported by flange 46 having a fork-like receiving section. Flange 46 is preferably pop riveted or the like to sidewalls 28 at both ends thereof. Secured to tube 44 at one end of flap 40 is biasing means 48 in the form of a weighted pendulum. The weighted pendulum may be replaced by other forms of biasing means such as by a spring or the like.

Arm 50 of the weighted pendulum abuts platform 52 when flap 40 is in its rest position. In this rest position, a light article, such as an aluminium can, that is placed on inlet slope 32 slides or rolls down inlet slope 32 through opening 36 and onto the inclined flap 40 where it again rolls or slides down flap 40 across platform 52 and into second collection zone 16 situated therebelow.

Stopper 54 is secured to one wall 28 at a position where the pivotal movement of the flap is retarded. In this form space 56 is such that a heavy article passing therethrough must abut both the first end 58 of flap 40 and the resilient restricting means 60 when flap 40 has been forced by the weight of the heavy article to its open position abutting stopper 54. The heavy article then passes to first collection zone 14. In other words, the flap 40 is pivotable between a first position in which it is inclined down to a first one of opposite side edges thereof towards the first receptacle 14, and a second position in which it is inclined down to a second of the opposite side edges towards the second receptacle 16. The flap member 40 is biased by biasing means 48 to its second dposition to provide a required biasing force such that a light refuse article is able to pass across the flap 40 into the second receptacle 16, and a heavy refuse article causes tilting of the flap member to the first position whereby the heavy article passes across the flap into the first receptacle 14.

The resilient restricting means 60 is preferably a thick rubber strip secured to the lower end of shield 38. The rubber strip will be deflected as a heavy article abuts thereagainst, serving to slow down the passage of the article from space 56 to the first collection zone 14. It is to be understood that the presence of the resilient restricting means is preferred only.

Figure 4:
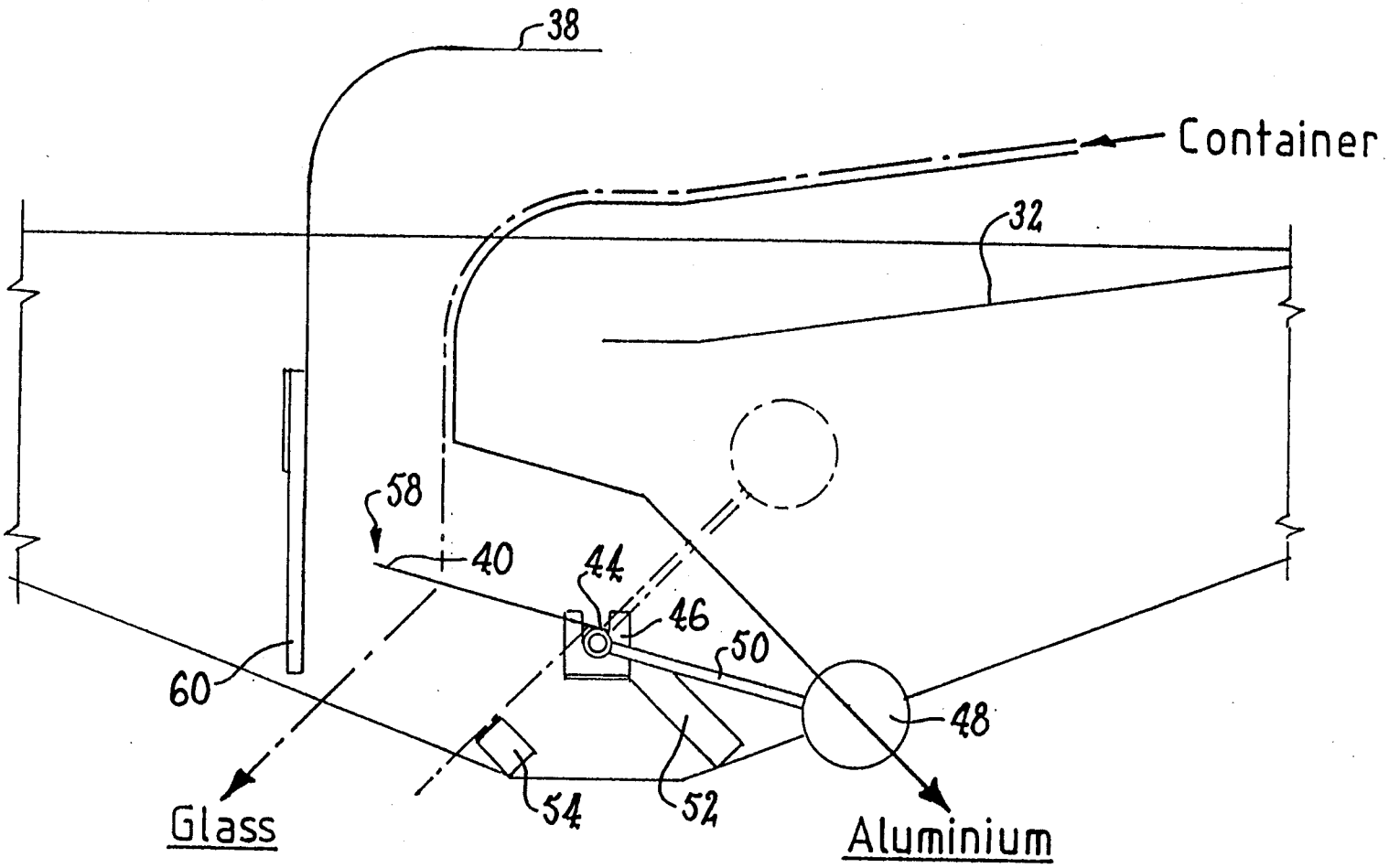
FIG. 4 is the section of FIG. 3 shown in diagramatic form to illustrate a preferred flow path.

FIG. 4 illustrates diagramatically the passage of light and heavy articles through the device referred to in the drawing as aluminium and glass containers respectively.

Those skilled in the art will also appreciate that there may be many variations and modifications of the configurations described herein which are within the scope of the present invention. The claims defining the invention are as follows:

I claim:

1. A refuse device, for receiving and separately holding heavy articles and light refuse articles, the refuse device comprising:

a mounting structure;

a first and a second open-topped refuse receptacle supported on the mounting structure such that top edges of respective side walls of the receptacles are laterally adjacent along a first horizontal line;

a cover means supported in relation to the mounting structure, above the receptacles, said cover means defining a guide surface which, relative to a second horizontal line normal to said first horizontal line, is inclined downwardly to an edge thereof which is located over an elongated feed region above said top edges such that articles of refuse received onto the guide surface are caused to pass down said guide surface into the feed region; and an elongate flap member mounted in and extending along the feed region above said top edges, the flap member having opposite side edges and being pivotable between a first position in which, relative to said second line, it is inclined down to a first one of said opposite side edges thereof towards the first receptacle, and a second position in which, relative to said second line, it is inclined down to a second of said opposite side edges towards the second receptacle, the flap member being urged to its second position by biasing means operable to provide a required biasing force such that a light refuse article which passes to the feed region from the guide surface is able to pass across the flap member into a collection zone defined by the second receptacle, and such that a heavy refuse article which passes to the feed region from the guide surface causes tilting of the flap member to said first position and then is able to pass across the flap member into a collection zone defined by the first receptacle.

2. A device according to claim 1, further comprising a resilient restricting means supported near the first of said opposed edges so as to define with the first of said opposed edges a space which allows passage of heavy articles and communicates with said collection zone defined by the first receptacle.

3. A device according to claim 2, wherein said resilient restricting means is adapted to engage said heavy article as it passes from the first of said opposed edges through said space to slow the speed of said heavy article as it enters the collection zone defined by the first receptacle.

4. A device according to claim 2, wherein said resilient restricting means is a heavy rubber strip.

5. A device according to claim 1, wherein the biasing means is a weighted member secured to the flap member suitable to urge the flap member into its second position with a predetermined force which is greater than the weight applied to the flap member by a light article but less than the weight applied to the flap member by a heavy article when the respective articles engage the flap member.

6. A device according to claim 1, wherein the cover member further defines an inlet opening protected by a shield such that articles are not able to be thrown or otherwise forceably placed therewithin.

7. A device according to claim 6, wherein the guide surface is angled such that articles may be placed on and then roll or slide down the guide surface, under the shield and through the inlet opening.

8. A device according to claim 1, wherein the first and second receptacles are in the form of baskets.

9. A device according to claim 1 or claim 8, wherein each of the first and second receptacles is pivotally attached to the mounting structure so as to be pivotable for discharge of refuse received therein.

* * * * *